United States Patent [19]

Vietzke et al.

[11] Patent Number: 4,562,001

[45] Date of Patent: Dec. 31, 1985

[54] MULTIPLE LAYERED TRANSPORTATION AND STORAGE CONTAINER FOR RADIOACTIVE WASTES

[75] Inventors: Horst Vietzke, Maintal; Elmar Schlich, Gründau; Günther Luthardt, Rodenbach; Hans Huschka, Hanau, all of Fed. Rep. of Germany

[73] Assignee: Nukem GmbH, Hanau, Fed. Rep. of Germany

[21] Appl. No.: 344,962

[22] Filed: Feb. 2, 1982

[30] Foreign Application Priority Data

Feb. 3, 1981 [DE] Fed. Rep. of Germany ..... 3103526

[51] Int. Cl.[4] ..... G21F 1/08

[52] U.S. Cl. ..... 252/633; 206/524.2; 250/506.1; 250/507.1

[58] Field of Search ..... 252/633, 628; 206/524.2; 405/128; 376/417, 416, 414, 411; 427/5, 6; 250/506.1, 507.1

[56] References Cited

U.S. PATENT DOCUMENTS

| | | | |
|---|---|---|---|
| 4,192,765 | 3/1980 | Bird et al. | 250/506 |
| 4,208,453 | 6/1980 | Baldi | 376/417 |
| 4,290,847 | 9/1981 | Johnson et al. | 252/636 |
| 4,292,528 | 9/1981 | Shaffer et al. | 250/506 |
| 4,337,167 | 6/1982 | Bird et al. | 252/633 |
| 4,343,659 | 8/1982 | Murakami et al. | 376/416 |

FOREIGN PATENT DOCUMENTS

| | | | |
|---|---|---|---|
| 0019346 | 11/1980 | European Pat. Off. | 376/417 |
| 0025847 | 4/1981 | European Pat. Off. | 252/628 |
| 0022098 | 2/1979 | Japan | 376/417 |
| 0089792 | 7/1980 | Japan | 376/414 |

*Primary Examiner*—Deborah L. Kyle
*Assistant Examiner*—Howard J. Locker
*Attorney, Agent, or Firm*—Cushman, Darby & Cushman

[57] ABSTRACT

For the transportation and long time storage of radioactive waste, especially of spent fuel elements, in suitable geological formations, there are needed multi-layered containers which guarantee a tight sealing even for a long period of time, are corrosion resistant to salt liquors, without being too expensive and too heavy. This is obtained by using for the individual layers of the container different metals or metal alloys which, from the outside inwardly, always are more noble (positive) in the electromotive (electrochemical) series.

18 Claims, 1 Drawing Figure

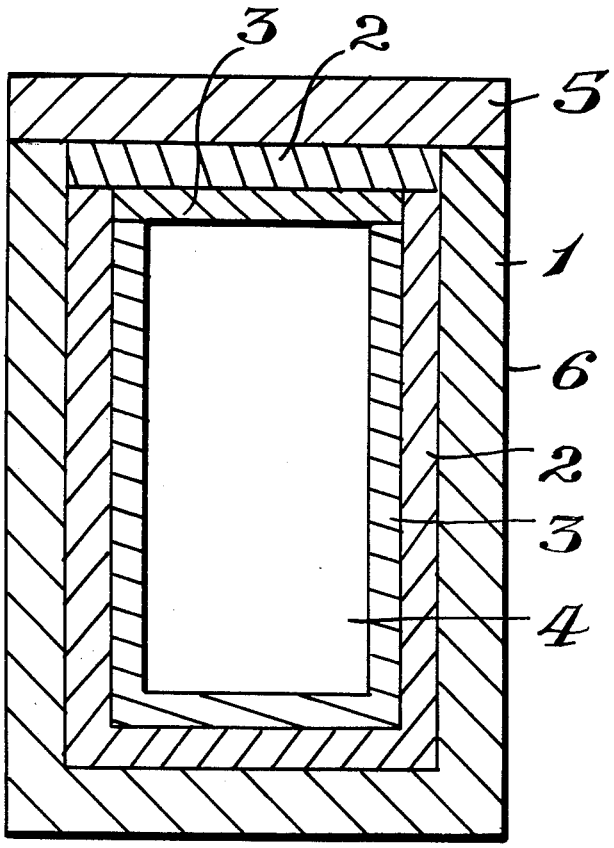
3
2
5
1
6
2
3
4

MULTIPLE LAYERED TRANSPORTATION AND STORAGE CONTAINER FOR RADIOACTIVE WASTES

BACKGROUND OF THE INVENTION

The object of the invention is a multi-layered transportation and storage container for the long time storage of radioactive wastes, especially from spent fuel elements, in suitable geological formations.

Irradiated, spent fuel elements after a temporary storage in water basins are either immediately or after a limited further intermediate storage worked up. Thereby, the nuclear fuel and fissile material of the fission products are separated and again supplied to the fuel cycle. The fission products according to known processes are conditioned, mostly using large amounts of valuable materials, as for example, lead and copper and are final stored in no longer removable manner in suitable geological formations.

Furthermore, there has been proposed (report of the Kernforschungszentrum Karlsruhe KFK 2535 and 2650) not working up the irradiated fuel elements in foreseeable time, to first give up the fuel and fissile materials in them and, after a suitable decay time in storehouses provided therefore, in a given case to again final store the fuel elements in non-removable manner. The storage time can range from several generations to several thousand years, whereby the potential danger of the radioactive inventory according to the known laws of physics in this time, depending on its composition, is extraordinarily greatly reduced.

Because of the undetermined storage time, there are placed especial requirements on such containers suited for the long time storage, which containers compared to known transportation and storage containers must have a much longer service life. Increasing the difficulty is the fact that the container storage must be accessible only with difficulty, and consequently limits are placed on the possibility of supervision.

There are known concepts which in part are very expensive for storing the irradiated fuel elements by means of containers made of metal or concrete in salt, sand, or in rock caves.

As packaging material for radioactive materials and irradiated fuel elements, there have been proposed containers made of alloyed and unalloyed steels, of copper as well as of corundum. The containers of steel are either not sufficiently resistant to corrosion or like those of copper are very expensive. Containers of corundum are basically suitable, but there is lacking the necessary experience for this production. Furthermore, the fuel elements for the packaging must be split up into small corundum containers for reasons of production which involves a considerable expense.

Such containers only partially fulfill the conditions of long time storage, such as tight sealing at the pressures and temperatures which occur, as well as corrosion-resistance against salt liquors, or they must be constructed with very thick walls. Besides, for the most part, they are not suited also simultaneously to be used as transportation containers so that there must take place a reloading of the waste from transportation containers into the final storage container.

Therefore, it was the problem of the present invention to provide a multi-layered transportation and storage container for the long time storage of radioactive wastes, especially from spent fuel elements, in suitable geological formation which guarantees a tight sealing even for a long period of time and above all is corrosion resistant to salt liquors without being too expensive and too heavy.

SUMMARY OF THE INVENTION

The problem was solved according to the invention by making the container of two or more layers of different metals or metal alloys which, from the outside inwardly, are always more noble (positive) in the electromotive (electrochemical) series. Through this, there is guaranteed that even with partial corrosive breakthrough of the outermost layer, the next inner layer, can only be attacked if the outer layer has completely decomposed. Therewith, the length of the time of resistance can be calculated, and the service life against corrosion is maintained even with unforseeable accidents.

It has surprisingly been found that there can be employed in multi-layered containers inexpensive metals for reaching the necessary container resistance if care is taken that the metal of the next innermost layer in the electromotive series stands higher than the metal of the outer layer. Now, if a breakthrough occurs in the outer jacket through partial corrosion by the salt solution as can occur in an accident, then the corrosion attack does not begin immediately on the nobler inner container because, based on the electromotive series, a potential between the two metals builds up in the electrolyte whereby the nobler metal or metal alloy of the inner layer becomes the cathode and the outer less noble metal passes anodically into solution. In this way, the entire metal of the outer jacket must first pass into solution before the inner layer is attacked. With a combination of, for example, three different layers, there is also calculable the time for the dissolution of the second jacket. Based on the rate of removal per unit of time and surface, there can be calculated the service life of the outer jacket in a specific corrosive medium, likewise, the service life of the second jacket and so on. Through this arrangement, it is possible to produce the outer jacket of a relatively cheap material, as for example graphite iron casting in order to give to the container the necessary rigidity for the 9 meter drop test for its suitability as a transportation container.

BRIEF DESCRIPTION OF THE DRAWING

The single FIGURE of the drawing is a schematic representation of a container of the invention.

DETAILED DESCRIPTION

The final storage container of the invention consists of the outer jacket 1 having welded on or rabbetted cover 5. As material, there is employed alloyed cast iron, preferably graphite cast iron. The first inner jacket 2 located in the outer container consists of nickel or a nickel alloy which is nobler in the electromotive series than the outer jacket 1. A too great potential difference is not desired in order that, in the case of the local formation of element, the passing of the outer jacket into solution is not too greatly accelerated. The second inner container 3 must again be nobler in material than the first inner jacket 2. Advantageously, there is employed here nickel-copper alloys. The inner space is filled with spent fuel elements of highly active waste. All three container layers are closed, which can occur, for example, by welding.

In corrosion tests, it has proven especially advantageous if the electromotive potential of the adjacent layers is not more than 50 to 500 mV from each other. Besides, it is possible to provide the container with additional coatings in the inner or on the outer container surface, or to insert an inner container of suitable material. Thus, for example, it is possible to insert a monolithic graphite block as an inner container.

The layer thickness of the outer layers is in the range of 5 to 20 cm, that of the additional nobler layers in the range of 5 to 50 mm. As corrosion resistance materials, there have proven good above all, bronzes, especially tin rich bronzes.

In the fixation of the series of metal layers according to the invention, there are naturally considered alloying components and their effect on the potentials, as well as on the corrosion behavior, as e.g., weld decay.

The entire disclosure of German priority application No. P 3103526.4 is hereby incorporated by reference.

We claim:

1. A multi-layered transportation and storage container for the long time storage of radioactive waste, especially fuel elements, in suitable geological formation consisting essentially of a container having at least three layers of different metals or metal alloys, said layers being increasingly noble in the electromotive series from the outermost layer inwardly.

2. A combination of the container of claim 1 and stored therein radioactive waste.

3. A container according to claim 1 wherein the outermost layer is made of cast iron and the adjacent inner layer is made of nickel or a nickel alloy.

4. A combination of the container of claim 3 and stored therein radioactive waste.

5. A container according to claim 3 having a further inner layer of copper or a copper alloy adjacent to the inner layer of nickel or nickel alloy.

6. A combination of the container of claim 5 and stored therein radioactive waste.

7. A container according to claim 5 wherein the difference of the electromotive potential of adjacent metal layers is in the range of 50 to 500 mV.

8. A combination of the container of claim 7 and stored therein radioactive waste.

9. A container according to claim 3 wherein the difference of the electromotive potential of adjacent metal layers is in the range of 50 to 500 mV.

10. A combination of the container of claim 9 and stored therein radioactive waste.

11. A container according to claim 1 wherein the difference of the electromotive potential of adjacent metal layers is in the range of 50 to 500 mV.

12. A combination of the container of claim 11 and stored therein radioactive waste.

13. A container according to claim 11 wherein the outermost layer has a thickness of 5 to 20 cm and the inner layers have a thickness of 5 to 50 mm.

14. A combination of the container of claim 13 and stored therein radioactive waste.

15. A container according to claim 9 wherein the outermost layer has a thickness of 5 to 20 cm and the inner layers have a thickness of 5 to 50 mm.

16. A combination of the container of claim 15 and stored therein radioactive waste.

17. A container according to claim 5 wherein the outermost layer has a thickness of 5 to 20 cm and the inner layers have a thickness of 5 to 50 mm.

18. A combination of the container of claim 17 and stored therein radioactive waste.

* * * * *